United States Patent [19]

Fuller

[11] 3,998,299

[45] Dec. 21, 1976

[54] BRAKE BEAM STRUCTURE

[75] Inventor: Oliver C. Fuller, Hinsdale, Ill.

[73] Assignee: Evans Products Company, Des Plaines, Ill.

[22] Filed: Sept. 15, 1975

[21] Appl. No.: 613,570

Related U.S. Application Data

[63] Continuation-in-part of Ser. No. 579,842, May 22, 1975, abandoned.

[52] U.S. Cl. ..... 188/223.1; 188/225.6

[51] Int. Cl.[2] ..... B61H 13/36

[58] Field of Search ..... 188/223.1, 225.6, 226.1

[56] References Cited

UNITED STATES PATENTS

| | | | |
|---|---|---|---|
| 2,500,232 | 3/1950 | Baselt et al. | 188/223.1 |
| 2,627,947 | 2/1953 | Spaeth | 188/223.1 |
| 2,646,861 | 7/1953 | Weisberger | 188/226.1 X |

FOREIGN PATENTS OR APPLICATIONS

| | | | |
|---|---|---|---|
| 695,181 | 8/1953 | United Kingdom | 188/225.6 |

*Primary Examiner*—Duane A. Reger

*Attorney, Agent, or Firm*—F. Travers Burgess

[57] ABSTRACT

A truss-type brake beam has end members with pockets for receiving the abutting end portions of the compression channel and tension bar members with the pocket rear wall abutting the rear surface of the compression member web and the front wall abutting the front surface of the tension member, the end portion of which is bent so as to extend parallel and in abutting relation with the front surface of the compression member web and which extends slightly beyond the end of the compression member, the protruding surfaces of the tension member being joined by a fillet weld to the end surfaces of the compression member web and flanges such that the fillet weld forms an abutment on the tension member engaging the entire end surface of the compression member whereby the tension member is maintained in tension. The end member rear and front walls are formed with windows, the peripheries of which are fillet-welded to the exposed surfaces of the compression and tension members.

12 Claims, 12 Drawing Figures

BRAKE BEAM STRUCTURE

This application is a continuation-in-part of my application Ser. No. 579,842 filed May 22, 1975 now abandoned.

BACKGROUND OF THE INVENTION

1. Field of the Invention

The invention relates to railway truss-type brake beam structure and consists in novel means for connecting the tension strap to the compression channel and a novel method of forming such beams utilizing the novel securing means.

2. The Prior Art

In Irvin J. Spaeth U.S. Pat. No. 2,702,614 the tension member end portions are upset to increase their thickness and to form a terminal lip for engagement with the end surface of the web of the compression member channel, the beam end members being secured to the end portions of the compression channel and tension strap by a rivet passing through the front and rear walls of the end members and through the tension and compression members received in the pocket defined by the end member front and rear walls.

SUMMARY OF THE INVENTION

The invention provides novel means for securing the tension strap to the compression channel by use of a fillet weld between the protruding end of the tension strap and the end surface of the channel web and flanges, thereby eliminating the expensive and time-consuming practice of upsetting the tension strap ends to form lips engageable with the end surfaces of the compression member channel webs of conventional truss-type beams in which the tension strap is maintained in tension by the engagement of an upset lip on each of its ends with the end surfaces of the compression member webs.

The invention further provides an improved and simplified method of manufacturing truss-type brake beams comprising an initial step of shearing a length of strap steel to sufficient length to entend beyond the ends of the brake beam channel member, bending the end portions of the tension member strap for parallelism with the compression member channel web, forcing the end portions of the strap into the channel and against its web by pressure, and tack-welding them to the channel flanges, and making a fillet weld between the rear, top and bottom surfaces of the protruding end portion of the tension member strap and the end surface of the channel web and flanges. The resultant structure, when assembled into the pocket of a beam end member and secured therein by fillet welds between the peripheries of windows in the forward and rear walls of the end member pockets and the front surface and the rear surface, respectively, of the tension strap and compression member web provides a stronger, simpler brake beam construction and eliminates the expensive and time-consuming steps of upsetting the end of the tension strap to increase its thickness and form the compression member engaging lip on it.

DETAILED DESCRIPTION OF THE INVENTION

Figure 1:
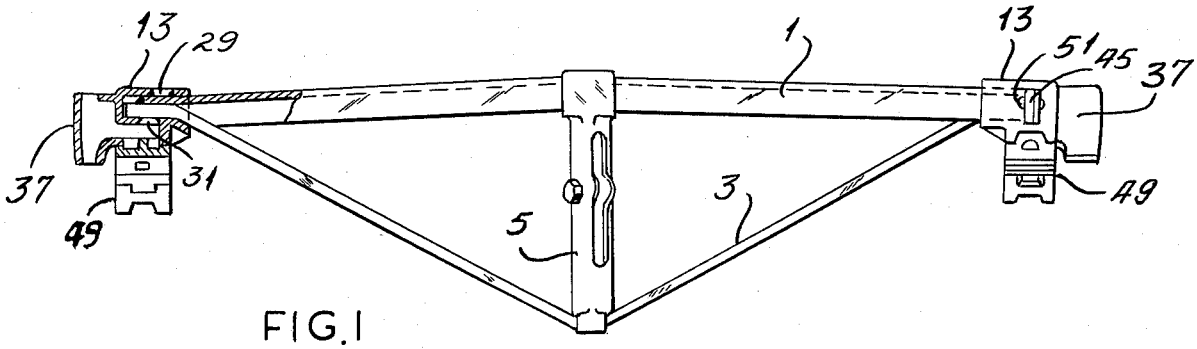
FIG. 1 is a top view of a brake beam embodying the present invention, one end of the beam being sectioned in part substantially horizontally along line 1—1 of FIG. 3.
Figure 2:
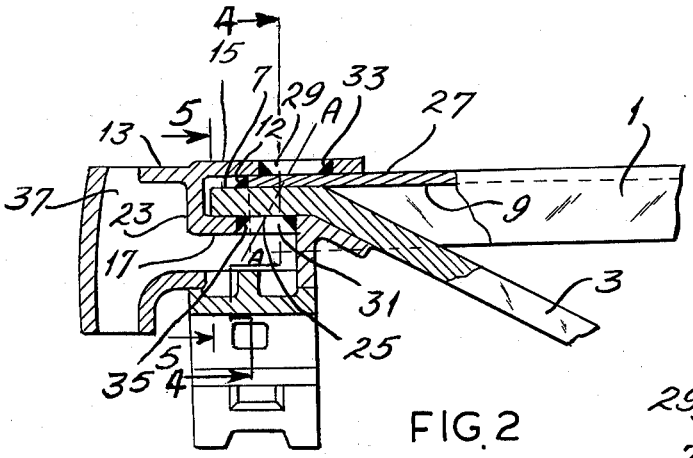
FIG. 2 is an enlarged horizontal sectional view of the left end of the beam illustrated in FIG. 1, taken in part along line 1—1 of FIG. 3.
Figure 4:
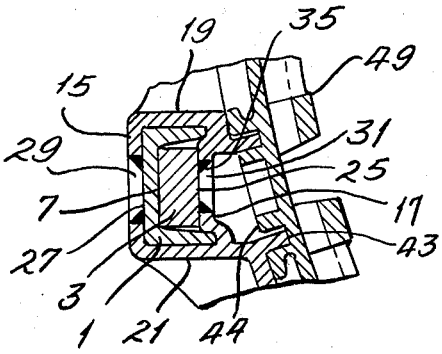
FIGS. 4 and 5 are similarly enlarged fragmentary vertical sectional views taken along lines 4—4 and 5—5 of FIG. 2.

The brake beam shown in the drawing comprises a truss having a compression member 1 of channel section, a tension member 3 in the form of a flat bar and a strut 5. Compression member 1 and tension member 3 converge from the middle of the beam, where they are separated by strut 5, toward each end of the beam where the end portions of the tension member are parallel to the compression member such that the rear upright face 7 of tension member 3 meets and extends alongside the forward face 9 of the compression member web. The extremities of the tension member protrude beyond the ends of the compression member, with the top, bottom and rear protruding surfaces continuously fillet-welded at 10, 11 and 12 respectively to the end surfaces of the compression member flanges and web respectively to form, in effect, an abutment on the tension member engaging and welded to the entire end surface of the compression member, so as to prevent separation of the tension member from the compression member when the beam is subjected to bending moments during brake applications.

This mode of securing the tension member to the compression member, by eliminating the necessity for a preformed shoulder on the end of the tension member (as shown at 6 in I. J. Spaeth U.S. Pat. No. 2,702,614) permits the use of plain flat bar stock for the tension member, which accordingly may be formed by a simple bending operation.

End members 13 form pockets receiving the ends of compression member 1 and tension member 3. Each of these pockets includes a rear wall 15, a front wall 17, a top wall 19, a bottom wall 21 and an end wall 23. Pocket front and rear walls 17 and 15 abut the front surface 25 of the tension member and the rear surface 27 of the compression member and thereby cooperate with fillet welds 10, 11, 12 to hold the ends of the tension and compression members assembled.

For securing end member 13 to the united ends of the compression and tension members, end member rear wall 15 is apertured to form a generally rectangular window 29 exposing a portion of the rear surface 27 of the compression member, and front wall 17 is apertured to form a smaller generally rectangular window 31 exposing a portion of the front surface 25 of the tension member. The central axis A of windows 29 and 31 is substantially normal to the longitudinal axis of the respective converging portion of the tension member, and fillet welds 33 and 35 respectively join the peripheries of windows 29 and 31 to compression member rear surface 27 and tension member front surface 25.

The use of fillet welds 33 and 35 instead of a rivet (such as that shown at 16 in I. J. Spaeth U.S. Pat. No. 2,702,614) permits the use of thinner sections at the ends of the tension member and does not require the thickening in these regions as shown in the Spaeth patent, thus also facilitating the use of plain flat bar stock for the tension member.

Figure 3:
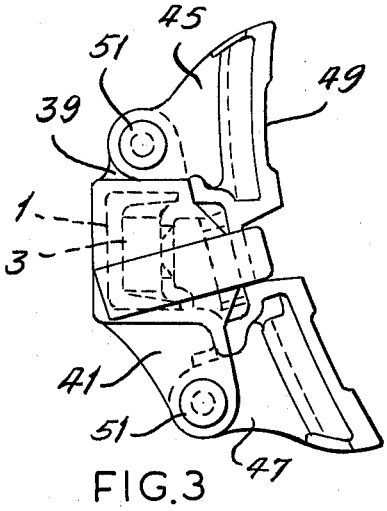
FIG. 3 is an end view of the beam illustrated in FIG. 1, drawn to the same enlarged scale as FIG. 2.
Figure 5:
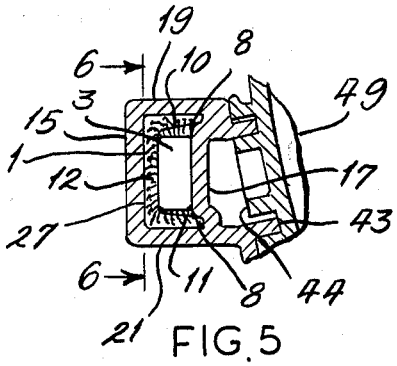
Figure 6:
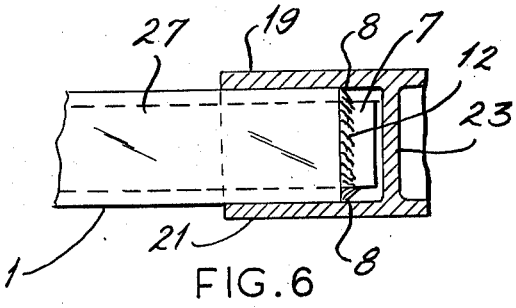
FIG. 6 is a similarly enlarged fragmentary sectional view taken along line 6—6 of FIG. 5.
Figure 7:
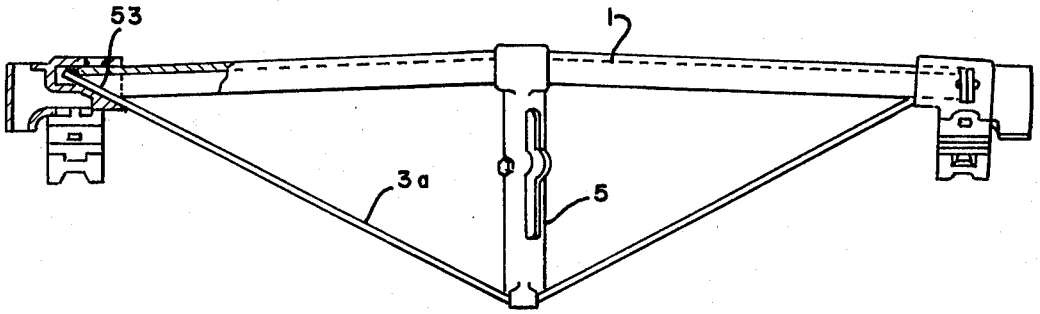
FIG. 7 is a top view of a brake beam embodying another form of the invention, one end of the beam being sectioned in part substantially along line 7—7 of FIG. 9.
Figure 8:
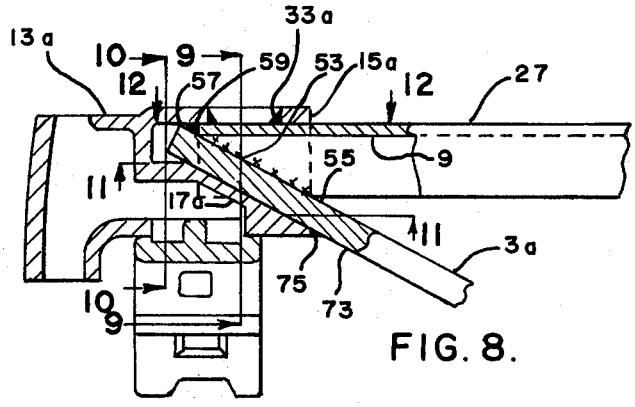
FIG. 8 is an enlarged horizontal sectional view of the left end of the beam illustrated in FIG. 7, taken in part along line 7—7 of FIG. 9.
Figure 12:
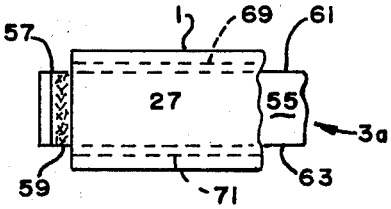
FIGS. 9, 10, 11 and 12 are enlarged fragmentary vertical sectional views taken respectively along line 9—9, 10—10, 11—11 and 12—12 of FIG. 8.
Figure 9:
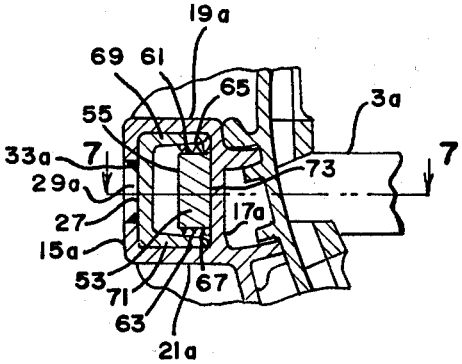
Figure 11:
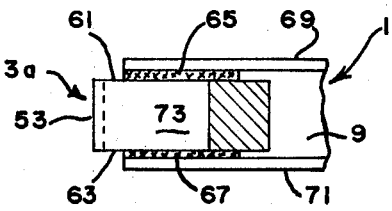
Figure 10:
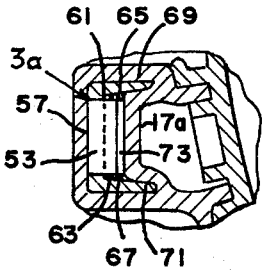

End member 13 is formed with a lateral extension 37 projecting from end wall 23 away from the end member pocket and the ends of members 1 and 3. Extension 37 is inclined from the general plane of the beam (FIG. 3) and is adapted for sliding receipt in a channel-shaped bracket (not shown) on the side frame of a truck to which the beam may be applied.

The top and bottom of end member 13 are formed, respectively, with upstanding and depending ears 39 and 41 to receive, respectively, corresponding ears 45 and 47 on shoe-mounting brake head 49, and the rear surface of the brake head is secured to the end member by rivets 51 through ears 39 and 45, and 41 and 47. The front of the end member is formed with a rectangular boss 43 to mate with a rearwardly projecting flange 44 on the brake head. The brake head is symmetrical about the central plane of extension 37 and about its vertical central plane, and hence may be turned top for bottom when applied to the end member, or may be used at either end of the beam.

The method of producing the beam described above comprises the steps of shearing the compression member channel 1 to predetermined length and shearing tension member strap 3 to a predetermined length sufficient that when bent to the shape shown in FIG. 1, its end portions will extend slightly beyond the ends of the compression member channel.

Strut 5 is secured to the midpoint of compression member 1. The end portions of the tension member strap are bent to enter the channel in the compression member in parallelism with the web of the latter and are pressed into engagement with the compression member web 27.

The protruding edges of tension member strap 3 are then tack-welded at 8 to the flanges of the compression member channel to form a truss structure, and thereafter a fillet weld 10, 11, 12 is made between the rear surface of the tension member strap and the compression channel web with radial portions extending along the top and bottom edges of the tension strap and merging with the original tack welds to form a continuous abutment preventing the tension member from separating from the compression member when the beam is subjected to bending moments during brake applications.

End members 13 are fitted on the united ends of the joined tension and compression members, with the latter received in the pockets defined by rear wall 15, front wall 17, top wall 19 and bottom wall 21, such insertion being facilitated by the fact that the compression and tension members are secured to each other by fillet welds 33 and 35 between the peripheral edges of windows 29 and 31 and the rear surface 27 of compression member 1 and the front surface 25 of tension strap 3 respectively.

The resultant structure is stronger as a result of the fillet weld between the tension member projecting surfaces and the compression member channel end surface, all longitudinal and transverse play of the two being prevented, as compared with the previous construction in which the tension member lips merely abuttingly engaged the ends of the compression member. At the same time the structure is less expensive to construct, since upsetting operations on the tension member, and drilling operations for the rivet holes in the prior art structure as well as the riveting operation are eliminated.

In the embodiment illustrated in FIGS. 7–12, the same reference numerals as are used in FIGS. 1–6 denote similar parts, modified parts are indicated by the same reference numerals followed by the letter *a*, and new parts are indicated by different numerals.

In this embodiment, tension member **3*a* consists of a steel strap the end portions 53 of which are straight and of sufficient length to overlap slightly the ends of compression channel member 1 such that when assembled with rear surface 55 of tension member 3*a* engaging the end of the front surface 9 of the compression member web, the rear corners 57 of tension member 3*a* are substantially aligned with the rear surface 27** of the compression member web.

The projecting ends of tension member **3*a* are secured to the end surface of the compression member web by a fillet weld 59 and the upper and lower edges 61 and 63 of end portions 53 of tension member 3*a* are butt-welded at 65 and 67 respectively to the inner surfaces of the top and bottom flanges 69 and 71 of compression member 1**, to form a unitary structure.

End members **13*a* are fitted on the united ends of the joined tension compression members 1 and 3*a*, with the latter received in the pockets defined by rear wall 15*a*, front wall 17*a*, top wall 19*a* and bottom wall 21*a*, front wall 17*a* being angled rearwardly from the open end of the pocket for abutting engagement with the front surface 73 of tension member 3*a*. Rear wall 15*a* of each end member 13*a* is formed with a window 29*a*, exposing the rear surface 27 of compression member 1 and a fillet weld 33*a* between the periphery of window 29*a* and rear surface 27 of compression member 1, and a fillet weld 75 between the outer edge of front wall 17*a* and the front surface 73 of tension member 3*a* secures each end member 13*a* in assembled relation to the united tension and compression members to form a stronger beam than those of the prior art because of the straight end portions of tension member 3*a* (which because they are initially straight do not tend to straighten out and thus elongate under load), the improved securement thereof by welds 59, 65 and 67 to the compression member web and flanges and the cooperation of the end member rear and front walls 15*a* and 17*a*** in holding the compression and tension members in assembled relation.

Details of the structure may be varied substantially without departing from the spirit of the invention and the exclusive use of such modifications as come within the scope of the appended claims is contemplated.

I claim:

1. In a railway truss-type brake beam, a compression member comprising a forwardly open channel and a tension member comprising a flat bar the end portions of which are of substantially the same thickness as the rest of the tension member, with their end portions converging toward the ends of the beam, said tension member end portions being received within the end portions of said channel member and projecting slightly longitudinally therefrom, a fillet weld joining the projecting rear surfaces of said tension member to the end surfaces respectively of said channel member web whereby to form an abutment integral with both said channel member and said tension member preventing separation of said tension member from the compression member when the beam is subjected to bending moments during brake applications, an end member mounted on each of said end portions, said end member having spaced top, bottom and rear walls respectively engaging the top, bottom and rear surfaces of said compression member end portion, a window in said rear wall exposing a major part of the portion of the rear surface of said compression member engaged by said rear wall, and a fillet weld along the periphery of said window between said rear wall and the rear surface of said compression member.

2. In a railway truss-type brake beam according to claim 1, said end member having a front wall engaging the front surface of the end portion of said tension member and a second window in said front wall exposing a major part of the portion of the front surface of said tension member engaged by said front wall, and a fillet weld along the periphery of said window between said front wall of said end member and said front surface of said tension member.

3. In a railway truss-type brake beam according to claim 2, the common central axis of said windows being substantially normal to the longitudinal axis of the respective converging end portion of said tension member.

4. In a railway truss-type brake beam according to claim 3, said tension member end portions each being bent into parallelism with said compression member web and positioned in abutting relation therewith.

5. In a railway truss-type brake beam according to claim 1, said end member being formed with a lateral extension projecting lengthwise of the beam beyond the ends of said compression and tension members for slidably engaging a support.

6. In a railway truss-type brake beam according to claim 5, said end member having a forwardly facing means for mounting a brake shoe.

7. In a railway truss-type brake beam according to claim 6, said brake shoe mounting means comprising a brake head, and means for removably securing said brake head to the forward face of said end member.

8. In a railway truss-type brake beam according to claim 1, a strut extending forwardly from the middle of said compression member and engaging the rear surface of said tension member intermediate its ends to space the latter from said compression member.

9. In a railway truss-type brake beam according to claim 1, said tension member end portions each being straight and intersecting said compression member web at an angle.

10. In a railway truss-type brake beam according to claim 9, said tension member end portion passing between said compression member flanges and having its top and bottom surfaces welded to the inner surfaces of the respective flanges.

11. In a railway truss-type brake beam according to claim 10, said front wall being positioned at a substantial angle with said rear wall whereby said top and bottom walls engage the top and bottom flanges respectively of said compression member, said rear wall engages the web of said compression member, and said front wall engages the front surface of said tension member.

12. In a railway truss-type brake beam according to claim 9, a strut extending forwardly from the middle of said compression member and engaging the rear surface of said tension member intermediate its ends, the angle between each of said tension member end portions and said compression member being related to the length of said strut and the halves of said compression and tension members divided by said strut that said tension member end portions are maintained in substantial alignment with the respective halves of said tension member.

* * * * *

UNITED STATES PATENT OFFICE

CERTIFICATE OF CORRECTION

Patent No. 3,998,299 Dated December 21, 1976

Inventor(s) Oliver C. Fuller

It is certified that error appears in the above-identified patent and that said Letters Patent are hereby corrected as shown below:

Column 4, line 65, "their end portions" should read --the end portions of said compression and tension members--; line 68, "channel" should read --compression--.

Column 5, line 1, "joining the" should read --joining each of the--; line 2, "the end" should read --the respective end--; line 3 should read --surface of said compression member web--; line 5, "channel" should read --compression--; line 9, "portions, said end" should read --portions, each said end--; line 12, "said" should read --the respective--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*